United States Patent [19]

Rasmussen et al.

[11] 4,195,399

[45] Apr. 1, 1980

[54] METHOD AND APPARATUS FOR INSERTING END CAPS INTO CORES OF WOUND ROLLS

[75] Inventors: Holger Rasmussen, Kilchberg, Switzerland; Paul N. Jespersen, Houston, Tex.

[73] Assignee: Georgia-Pacific Corporation, Portland, Oreg.

[21] Appl. No.: 895,483

[22] Filed: Apr. 11, 1978

[51] Int. Cl.[2] ..... B21D 39/03

[52] U.S. Cl. ..... 29/429; 29/451; 29/786; 29/789; 29/235

[58] Field of Search ..... 29/525, 429, 450, 451, 29/234, 235, 771, 773, 790, 789, 786, 787

[56] References Cited

U.S. PATENT DOCUMENTS

| | | | |
|---|---|---|---|
| 2,714,761 | 8/1955 | Wampole | 29/235 X |
| 2,777,189 | 1/1957 | Evelyn | 29/790 X |
| 4,096,620 | 1/1978 | Kontz | 29/773 X |

*Primary Examiner*—Leon Gilden

*Attorney, Agent, or Firm*—Schuyler, Birch, McKie & Beckett

[57] ABSTRACT

End caps are pressed into the opposite ends of cores of wound rolls of paper, such as toilet tissue, paper towels and the like, by transferring end caps in succession from a rotating drum feeder located at each side of the path of movement along which the rolls are moved to end cap holders mounted to move in an endless course at each side of the roll path wherein each holder picks up an end cap from its adjacent feeder and moves it in synchronism with movement of the rolls along the roll path. The endless course of the end cap holders at each side of the roll path has a portion thereof which travels along a line that approaches the center line of the roll path so that the end cap holders each press an end cap into an end of the roll core and release the cap to the roll. A positioning paddle having radial blades is mounted to rotate on an axis below and perpendicular to the center line of the roll path with the blades engaging rolls in succession and moving them along the roll path in synchronism with movement of the holders along the portion of endless course which approaches the roll path center line.

19 Claims, 19 Drawing Figures

METHOD AND APPARATUS FOR INSERTING END CAPS INTO CORES OF WOUND ROLLS

BACKGROUND OF THE INVENTION

1. Field of the Invention

This invention relates generally to method and apparatus for automatically inserting end caps into wound rolls such as toilet tissue, paper towels, and the like. Particularly the method and apparatus used in transferring the end caps first into an inserting device and then subsequently using the inserting device to press the end caps into the core of the wound roll is deemed important.

2. Description of the Prior Art

Many applications have arisen in the prior art and in commercial use where wound rolls of paper, such as toilet tissue, paper towels, and the like, have required the application of end caps to the conventional open core ends of the roll. A number of different dispensers for wound rolls have been developed in the prior art where end caps having spindles projecting outwardly from the end caps make use of these spindles to mount the rolls in the dispenser.

Also, in dispensers used for dispensing wound roll materials it has been necessary to use end caps having a spindle of one diameter at one selected end and a spindle of a different diameter at the opposite end of the roll. This usage and practice is necessary in many applications where installing the rolls into the dispenser makes it important if not essential for the proper end of the roll to be applied to the proper side of the dispenser so that a small spindle end would not be applied where the large end spindle end cap should be used. The necessity for properly installing the rolls can have a major impact on the perfection of operation of the dispenser in use and thus an improperly installed roll could result in the dispenser being inoperative. Accordingly, it is known in the industry that the projecting spindle in the left end of the roll core is to be of greater diameter than the projecting spindle on the end cap inserted in the right roll core end. This ensures that the rolls are loaded properly into the dispenser.

Also, in many commercial installations it is only economical and practical to employ dispensers that can store a plurality of rolls within the dispenser with each roll successively moving into use once the material on the first roll is exhausted. In such dispensers it becomes absolutely critical to have the rolls properly installed since the successive feeding from the multiple rolls could not take place where one roll or another roll is put in backwards or improperly installed. Again this creates the criticality in having the end caps not only firmly frictionally held within the ends of the core but also that the large spindle end cap be in the proper end and the small spindle end cap be in the other roll core end.

Certainly, the expense and labor required to install end caps in the opposite core ends of wound rolls for the large commercial volumes of wound rolls produced and used daily contributes a major problem for the roll producers to inexpensively supply the rolls with the end caps in place and also to be sure that the relationship of the different sized end caps to the core ends in which they are installed in all ways correct.

The machines for end cap insertion that are in general use today frequently rely on springs to hold the end caps in proper position for insertion. These springs are subject to deformation which naturally causes malfunctioning of the machine. Thus, such prior equipment has not provided a practical answer to the problem of continuous high speed and accurate insertion of end caps into wound roll materials.

SUMMARY OF THE INVENTION

The purpose of this invention is to provide a simple and economical means for transferring and inserting the end caps without the use of springs while positively retaining the end caps in proper position at all times. This transferring and inserting is done by moving the end cap gradually into the inserting device then subsequently gradually into the core which permits high volume and high speed operation.

A principal object of the invention is to provide for accurate transferring and inserting end caps into the open core ends of roll material at a high speed with economical and reliable insertion of the end caps.

Another important object of the invention is a method of inserting end caps wherein each wound roll is moved at a predetermined speed along a path, an end cap holder carrying an end cap is moved along a course at the same predetermined speed along the side of the path with a portion of the course approaching the center line of the path to press the end cap into the core end of the roll.

It is a further object of this invention to provide apparatus for inserting end caps into roll core ends where the roll is transported at a predetermined speed and an end cap holder at each side of the path of roll movement is mounted on carriers which move holders supporting end caps toward the ends of the roll as the holders are moved at the same predetermined speed as the roll transporting means.

The above and other more specific objects will be recognized as reference is made hereinafter to the drawings and description of a preferred embodiment of this invention.

BRIEF DESCRIPTION OF THE DRAWINGS

The novel features of the invention are set out with particularity in the appended claims, but the invention will be understood more fully and clearly from the following detailed description of a preferred embodiment of the invention as illustrated in the accompanying drawings, in which:

DESCRIPTION OF A PREFERRED EMBODIMENT

Figure 1:
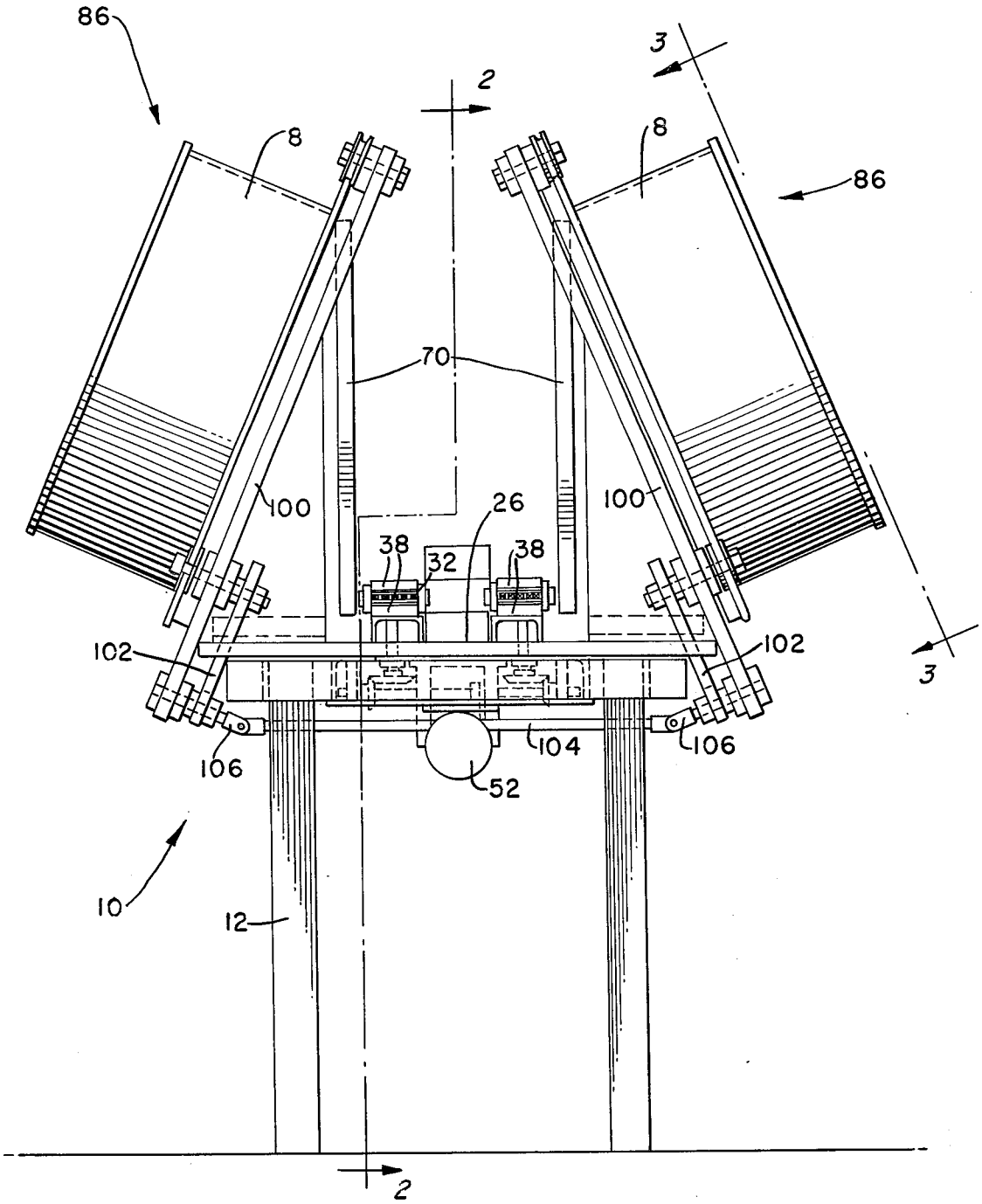
FIG. 1 is an end view of the apparatus for inserting end caps into cores of wound rolls taken from the output end of the apparatus.
Figure 2:
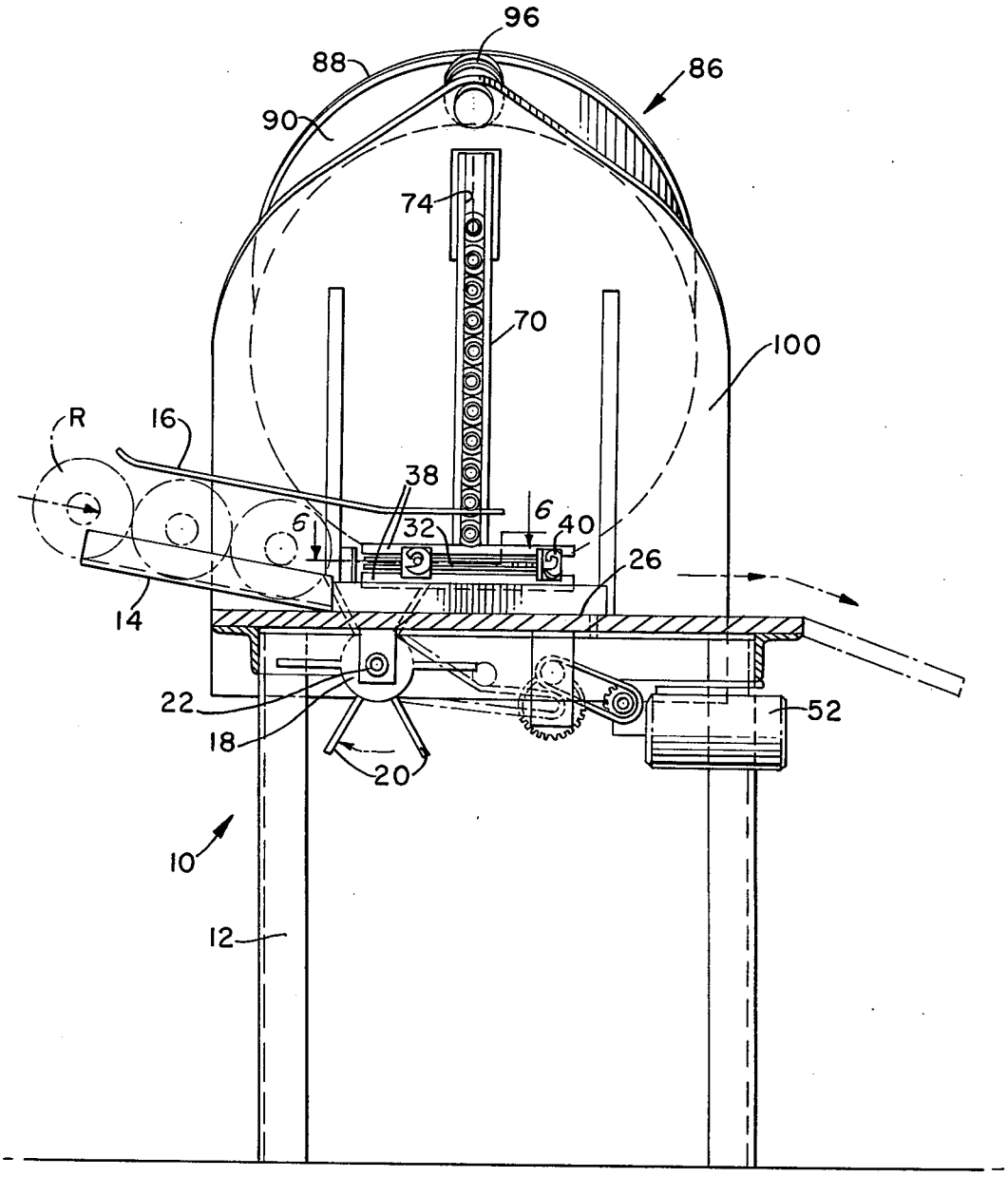
FIG. 2 is a sectional view taken on line 2—2 of FIG. 1.
Figure 17:
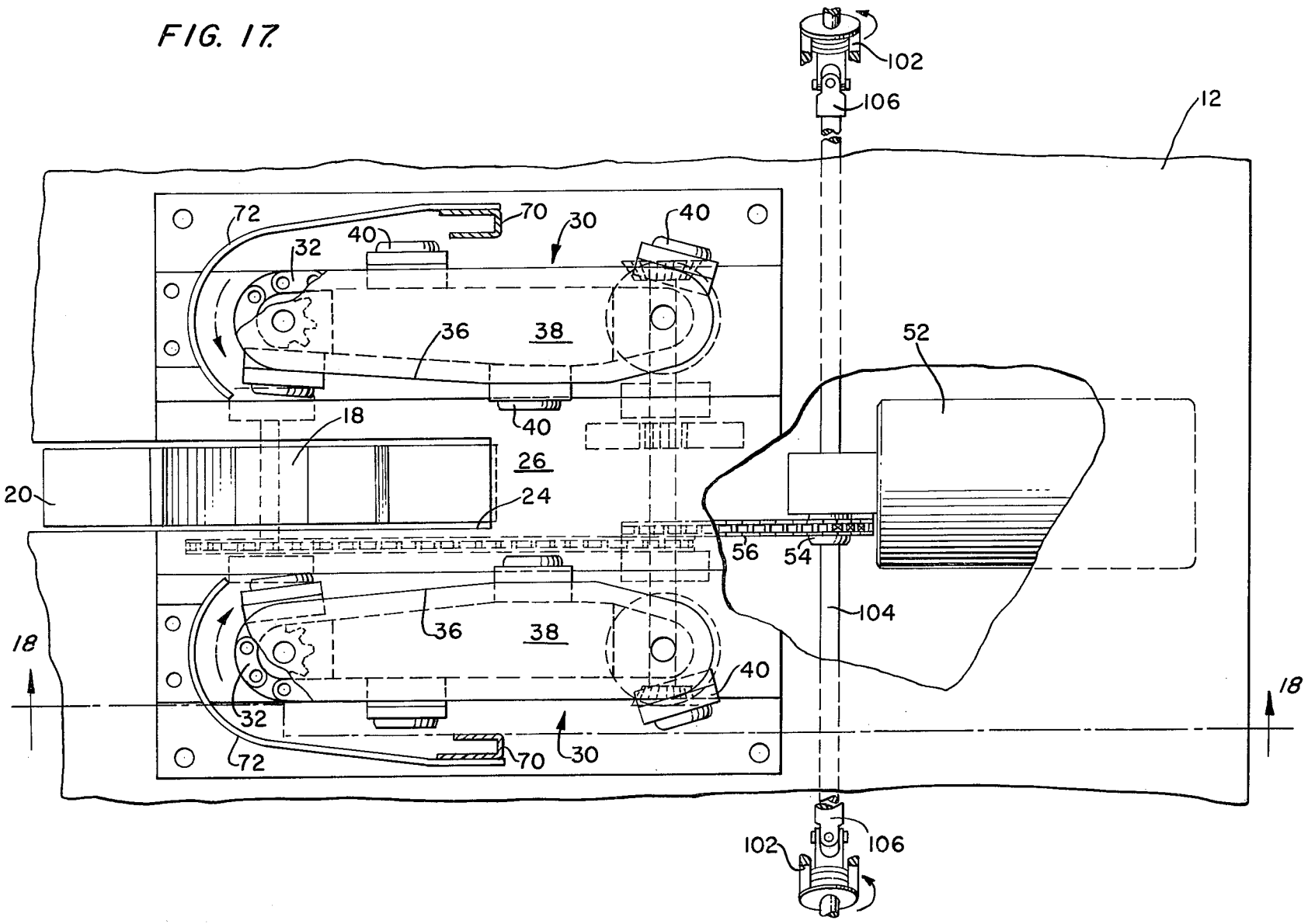
FIG. 17 is an plan view with a portion broken away showing the assembly of the end cap inserter.
Figure 18:
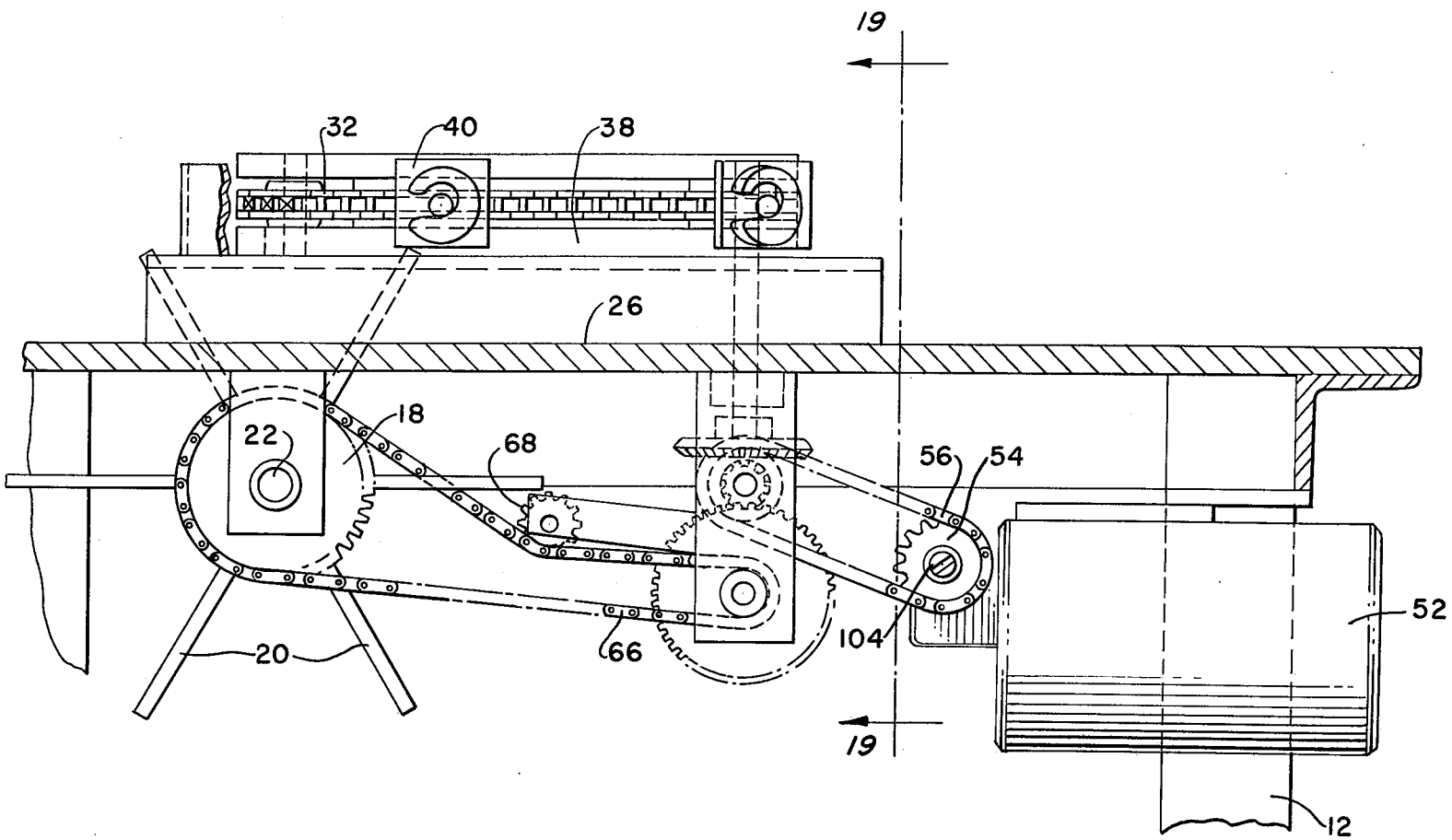
FIG. 18 is a view taken on line 18—18 of FIG. 17.

Referring to the drawings that show a preferred embodiment of the invention probably the best overall view and understanding of the invention may be obtained by referring to FIGS. 1, 2, 17 and 18. FIG. 1 shows the output end of the end cap inserter for wound rolls, such as tissue paper, paper towels and the like. FIG. 2 shows a sectional view through the length of the apparatus. FIG. 17 shows a plan view of the apparatus while FIG. 18 gives in more detail a sectional view through critical operating components.

Figure 13:
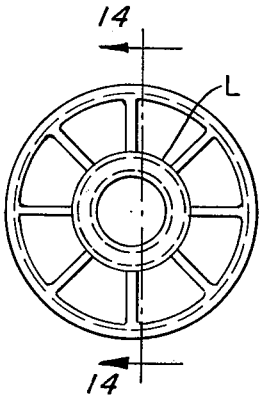
FIG. 13 is an end elevational view of a large end cap.
Figure 14:
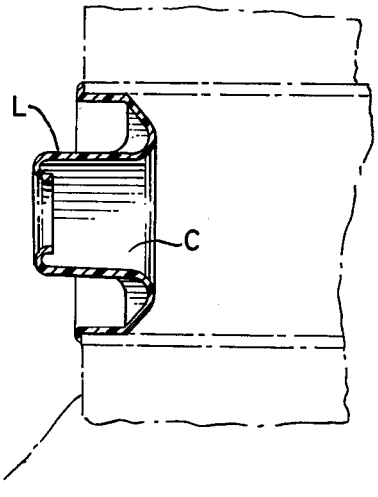
FIG. 14 is a sectional view taken on line 14—14 of FIG. 13.
Figure 15:
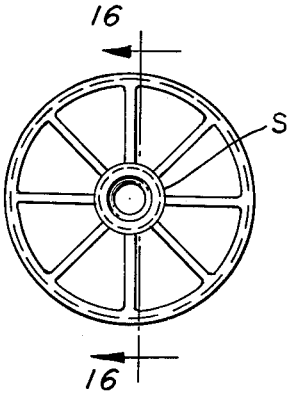
FIG. 15 is an end elevational view of a small end cap.
Figure 16:
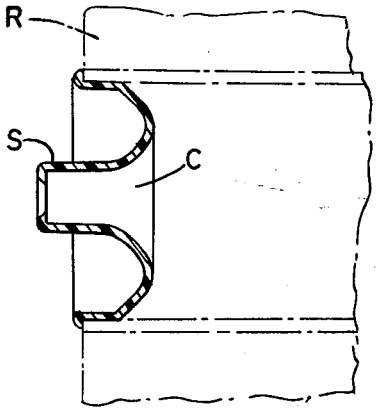
FIG. 16 is a sectional view taken on line 16—16 of FIG. 15.

The end cap inserting apparatus 10 is shown supported on a suitable table 12, the top of which forms the bed for the apparatus. The rolls into which the end caps are to be inserted have a core with open ends. The end caps are frictionally pressed and are retained within the core of each roll at both ends of the core. These end caps generally have an outwardly projecting spindle which is utilized in mounting the roll in its enviornment of use. FIGS. 13 and 14 show one type of end cap with a large spindle L whereas FIGS. 15 and 16 show a end cap provided with a smaller spindle S. FIGS. 14 and 16 show in section the manner in which the end cap appears once it has been pressed into the open end of the core of the roll. It may be mentioned that in practice it is normal to use a large spindle end cap at one end of the roll core and a small spindle end cap at the other end of this core. This provides better assurance against a roll being installed in a dispenser in the wrong position or direction so that the dispenser is not properly operable. Thus, as shown in FIG. 14, the large spindle L for the end cap C is shown inserted in a roll R while in FIG. 16 a small spindle S end cap C is shown inserted in the opposite core end of a roll R.

Referring to FIG. 2, three rolls R are shown in phantom in their position for entrance into the end cap inserting apparatus. They are supported on a downwardly inclined feeding trough 14 which leads into the apparatus and carries the rolls successively into a path along the top of table 12 through which they are moved under controlled conditions to obtain the end cap insertion in the roll core open ends. A roll retainer plate 16 overlies the trough and a portion of the path through which the rolls are passed within the apparatus to retain the rolls in proper position for their handling in the end cap inserting operation.

A roll positioning paddle 18 having radial blades 20 is mounted on a shaft 22. The shaft 22 is disposed with its axis below and perpendicular to the center line of the roll path 26 along the top of table 12 which each roll traverses in moving through the end cap inserting apparatus. The paddle 18 is driven by means which will be described subsequently. The blades 20 of the paddle extend upwardly through an opening 24 formed in the top of table 12 in the path 26 that the rolls traverse in having the end caps inserted into their cores. From FIG. 17, it will be seen that the blades 20 of the paddle 18 extend upwardly essentially in the center of roll path 26 through opening 24.

Each roll R as it moves down inclined trough 14 will come in contact with the rotating paddle 18 and each roll will locate itself between two of the blades to be precisely moved and driven through the initial portion of the roll path 26. As one roll R is driven beyond the paddle blades a following roll will enter between the next pair of blades 20 and thus the rolls will effectively push each other along the remainder of the path 26 in operation of the machine. In this procedure, it will of course be recognized that the open ended core of the roll will have the core ends exposed along the opposite sides of the roll path 26.

Figure 6:
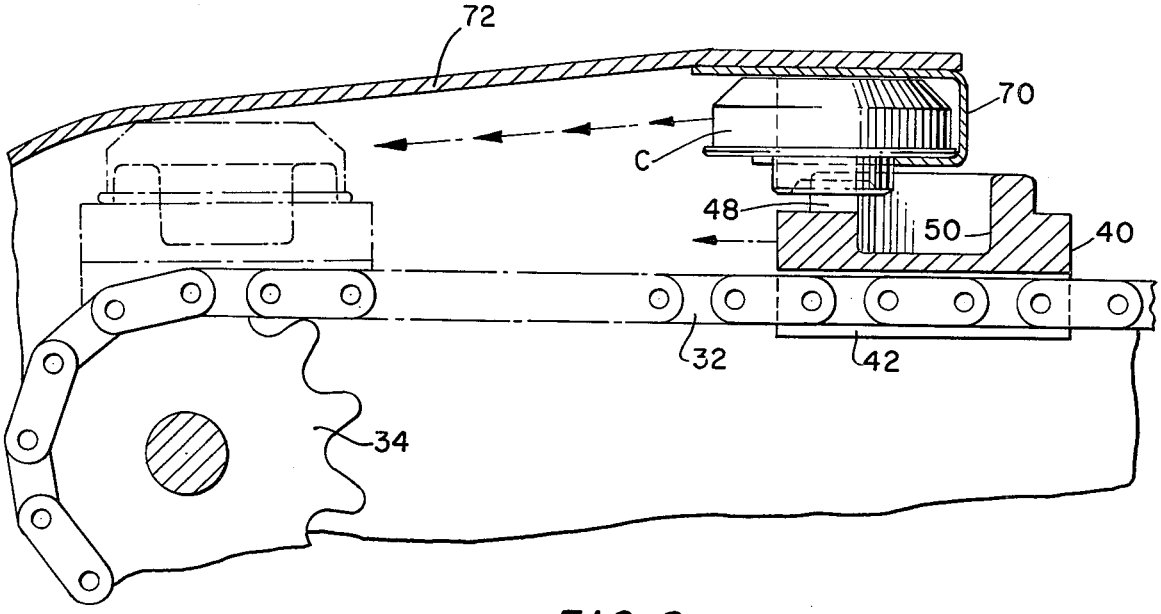
FIG. 6 is a partial sectional view taken on line 6—6 of FIG. 2.

Along each side of roll path 26 there is provided a carrier 30. Each carrier 30 is basically similar although they are of right and left hand construction to accommodate the right and left sides of the roll path 26. Each carrier 30 has a suitable roller chain 32. The chain passes around sprockets, such as 34 (FIG. 6), rotatably mounted at opposite ends of each carrier 30. The sprockets are mounted to support the chain to carry it through a predetermined defined course. The sprocket at one end of each carrier 30 has a drive shaft extending through the top of table 12 and driven by mechanism which will be described hereinafter.

Although the course of the roller chain 32 on each carrier 30 travels in a straight line on its length remote from the side of roll path 26 where the particular carrier is located, the chain 32 is provided with sufficient slack around the end sprockets of each carrier 30 to be guided in a particular portion 36 (FIG. 17) of the course where it is adjacent the side of the roll path 26. During this portion 36 of the course, the chain, carrying end cap holders 40, on each carrier 30 is guided by stationary members 38 fixed above and below the chain to compel it to follow a line that approaches the center line of the roll path, as shown at 36. It will be noted that both the left and right hand carriers 30 have the approaching portion 36 so at the input end where the roll enters the end cap inserter the chains are at a further distance from the sides of the roll path 26 in both the right and left hand carriers 30. It will be noted that with the portion 36 of the course of the chain 32 around the sprockets 34 (as guided by end cap holders 40 riding along the edges of members 38 in each carrier 30) approaching the center line of the roll path 26, the chain 32 on each carrier in effect has a generally oval confi guration as easily seen in FIG. 17.

Each roller chain 32 of each carrier 30 has secured at spaced positions along its length, a plurality of end cap holders 40. Four such spaced end cap holders 40 are illustrated by way of example on the two carriers 30 shown in FIG. 17. These holders 40 may be suitably secured at properly spaced positions along the roller chain 32 by pinning the holders to the chain which is to be driven around the sprockets 34.

Figure 10:
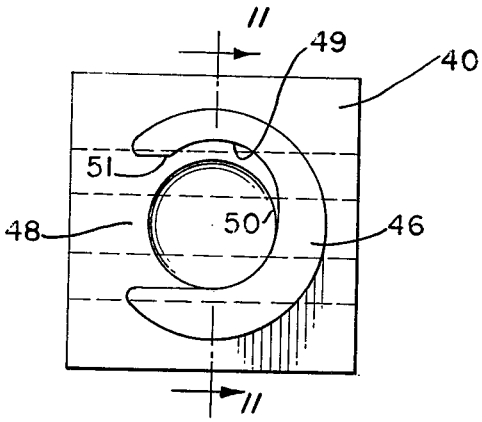
FIG. 10 is an elevational view of one of the end cap holders.
Figure 11:
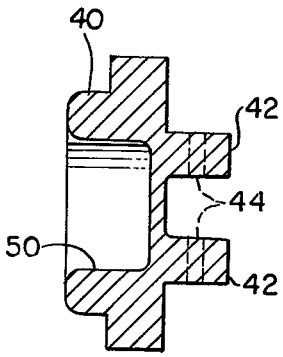
FIG. 11 is a sectional view taken on line 11—11 of FIG. 10.
Figure 12:
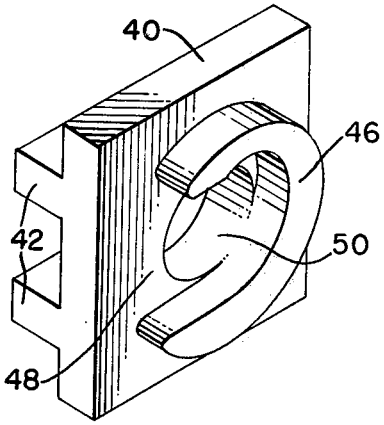
FIG. 12 is a perspective view of the end cap holder.

The construction of the holders 40 is best illustrated in FIGS. 10, 11 and 12. Each carrier 40 has a pair of ears 42 spaced on the inner side of the holder. These ears fit over and under the roller chain 32 and are provided with small bores 44 which allow pins to be inserted into the chain to hold the end cap holders 40 on the chain 32 at their proper positions. The form of the end cap holder is important in that it must pick up an end cap C from a cap feeding means, carry it around the end of a carrier 30 to the roll path 26 and then press it into the open core end of a roll being moved along by paddle 18 whereupon the roll is moved beyond the paddle and through the length of path 26 to be discharged with the end caps C firmly engaged by friction within the ends of the core of roll R.

The holder 40 has an outwardly projecting boss 46 on the outer side of the holder. This boss is generally semi-circular with a laterally opening slot 48 therein. This laterally opening slot 48 permits the spindle of an end cap C to enter the boss 46 and be carried along in the operation of the inserting apparatus. A recess 50 extends into the holder 40 from the boss 46 and laterally opening slot 48. This permits the spindle of an end cap to move into the recess 50 to be more effectively held while transferring and inserting the end cap into the roll core. The boss 46 on each end cap holder 40 has a space 49 formed in the upper curvature of the boss above the recess 50, as shown more clearly on FIG. 10. Also, an upper inside face 51 is provided on the boss 46 at the upper forward end of the holder. The function of these configurations will be described subsequently in connection with the action of end cap holders in picking up end caps from the end cap feeder.

Figure 19:
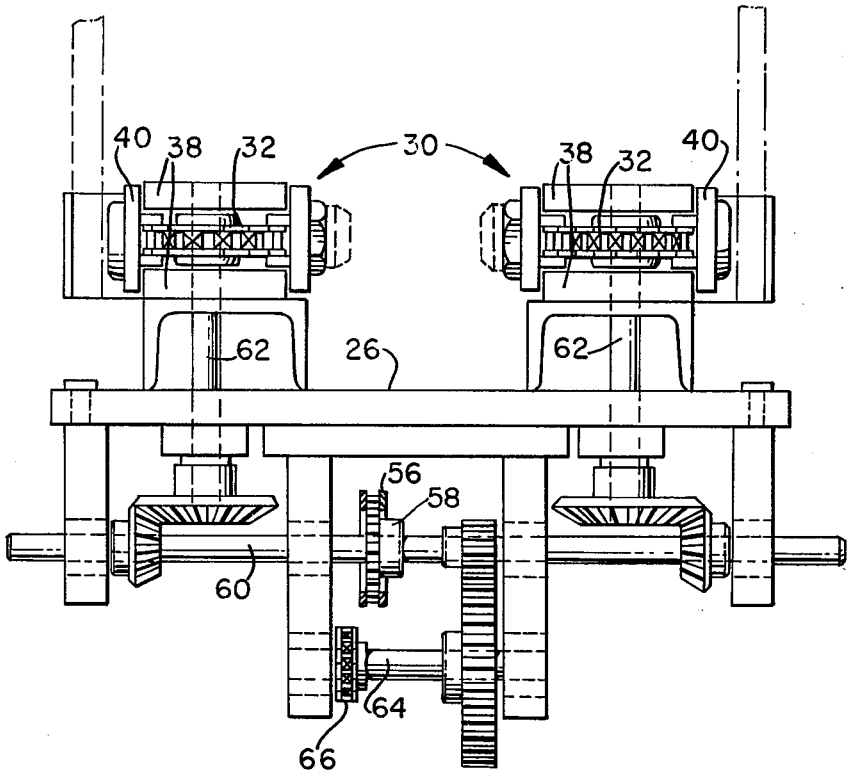
FIG. 19 is a view taken on line 19—19 of FIG. 18.

The drive for the synchronization of rotation of paddle 18 with the movement of the two carriers 30 on the opposite sides of roll path 26 may best be understood by reference to FIGS. 17, 18 and 19. It is important that the paddle rotation and the movement of chains 32 on the carriers 30 be at the same predetermined speed to move each roll in synchronism with end cap holders 40. Desirably a roll enters the apparatus and is picked up by the blades 20 of paddle 18 which is continuously rotating. When the roll reaches the point where it is centered over the axis of shaft 22 an end cap holder 40, carrying and holding an appropriate end cap C, must arrive on chain 32 of a carrier 30 to place this end cap in alignment with the center of the core of the roll which is to have end caps inserted into its core ends. The carriers 30 must then move the holders 40, carrying the end caps now being pressed into the core ends, at the same speed that the paddle 18 moves the roll onwardly down the roll path 26. This timing is simply and effectively obtained by utilizing a drive for the paddle 18 and carriers 30 that will insure synchronous speed of movement of these components with the end caps being inserted aligned with the roll core axis.

To achieve this synchronous drive, a suitable gear motor 52 is mounted on the underside of the top of table 12. This motor drives a sprocket 54 on shaft 104 which drives a roller chain 56. Chain 56, in turn, drives a sprocket 58 mounted on a main drive shaft 60. Bevel gears are carried adjacent the ends of main shaft 60 which, as shown in FIG. 19, drive shafts 62 that extend upwardly through the top of table 12 and are connected to sprockets 34 within the carriers 30 to thereby effect driving of the roller chains 32 in each of the carriers 30. Thereby the end cap holders 40 are moved in the oval course defined by the guiding of chains 32 in the carriers along the course portions 36 shown on FIG. 17. Main shaft 60 and an idler shaft 64 have intermeshing gears thereon so that rotation of shaft 60 drives idler shaft 64. In turn idler shaft 64 has a chain 66 driven by a sprocket secured on idler shaft 64 and running to drive a sprocket carried by paddle 18. A suitble paddle adjusting sprocket 68 may be engaged with drive chain 66 for appropriate tensioning of chain 66 in connection with adjustment of paddle 18. It will thus be seen that upon energization of gear motor 52, the driving train running to the chains 32 on the two carriers 30 and the paddle 18 will be driven in complete synchronization at the same predetermined speeds for moving the end caps and roll in synchronism in carrying out the end cap inserting operation.

Referring back to FIG. 17, the feeding means for supplying end caps C to the end cap holders 40 as they move along on carriers 30 is provided by a feeder channel 70 which holds a supply stack of end caps. A channel 70 for feeding end caps is provided for each of the carriers 30 such as shown in FIG. 1. In FIG. 2, one of the feeder channels is shown in its position extending upwardly from the bed of the apparatus to a rotary drum feeder that supplys end caps to a channel 70 that will be described later.

Associated with the feeder channel 70 is a curved plate 72. A curved plate 72 associated with each channel 70 and carrier 30 performs the function of not only holding the end cap in the end cap holder 40 but also by being curved around the end of the carrier it urges the cap into the recess 50 of the holder 40 as the carrier 30 moves the holder with an end cap around to the operating position to meet and align with the open core end of a roll. When the end cap, holder and roll simultaneously continue along roll path 26, the portion 36 of the course through which each carrier moves approaches the center line of the roll path. This effectively presses the end caps into the core where they become firmly frictionally held by the core as the carriers proceed down the roll path 26. Then courses of the carriers move away from the path at their downstream end to return the end cap holders 40 around the ends of the carriers 30 to pickup new end caps from the feeder channels 70. It will be noted that the channel 70 in FIG. 2 shows it fully stacked with end caps.

Figure 7:
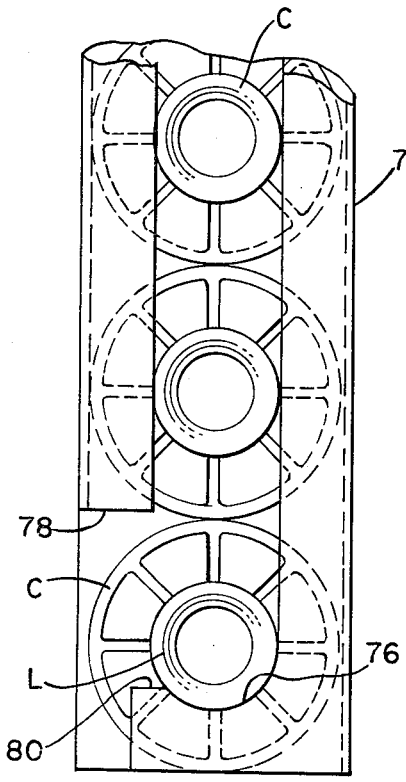
FIG. 7 is a view showing the bottom portion of the end cap feeding channel with the supporting saddle holding an end cap with other end caps stacked in the channel thereabove.
Figure 8:
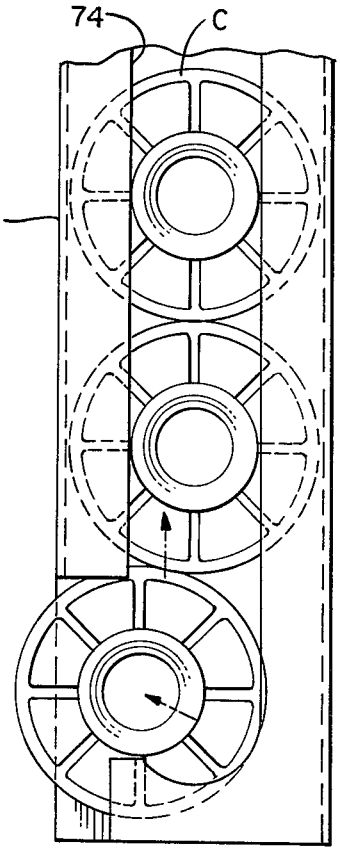
FIG. 8 is a view similar to FIG. 7 but showing the lower most end cap being removed from the stack of caps in the feeding channel.
Figure 9:
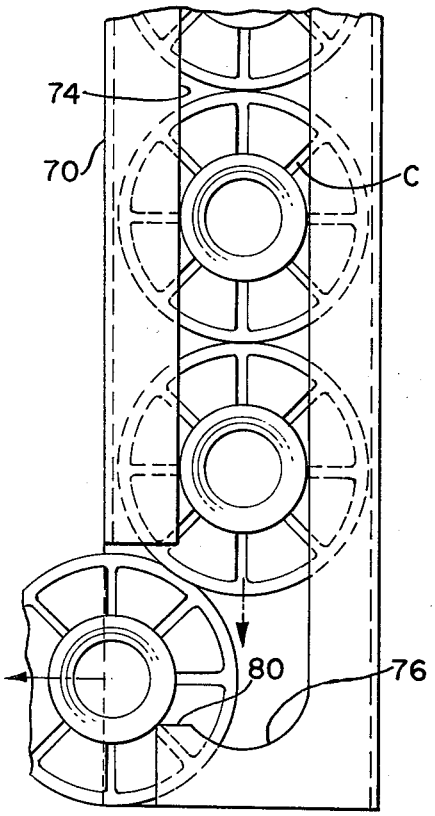
FIG. 9 is a view similar to FIGS. 7 and 8 with the lower most end cap removed from the feeding channel and the remaining end caps moving downwardly for the new lower most end cap to be retained in the supporting saddle in readiness for removal from the channel.

The functioning of pick up from the feeder channel 70 is best illustrated with reference to FIGS. 6 thru 9. Considering FIGS. 7, 8 and 9, each shows the bottom portion of a stack of end caps C held within an end cap feeder channel 70. FIG. 7 shows the stack of end caps in the waiting position with the lower most cap in location to be picked up by an approaching end cap holder 40 moving on a carrier 30 under the driving power of roller chain 32. FIG. 8 shows the motion that takes place when the lower most end cap is being removed from the stack of end caps and FIG. 9 shows the lower most end cap moving out of channel 70, now under control of an end cap holder 40 moving along on one of the carriers 30.

Each end cap feeder channel 70 has a longitudinal slot 74 extending upwardly and through which the spindles of the end caps project when they are held within the feeder channel 70. At the lower end of the longitudinal slot 74 there is a saddle 76. In FIG. 7 the lower most end cap C has its spindle L resting in the saddle 76.

Solely for purposes of illustration the embodiment illustrated shows a stack of end caps C with large spindle L resting in the saddle 76. When small spindle end caps are being fed, transported and inserted in the opposite ends of roll cores the dimensions of components involved in these functions can be changed as needed.

A lateral opening 78 extends from the lower end of longitudinal slot 74 to open outwardly so that the end cap may be removed and passed laterally along when picked up by an end cap holder 40. A shoulder 80 is provided between the saddle 76 and the outer end of the lateral opening 78. This restrains movement of the lower end cap from the feeder channel 70 until it is physically engaged by an end cap holder 40 moving along on a carrier 30.

As previously mentioned, the boss 46 on the end cap holder 40 has a space 49 formed at the upper curvature of the boss above the recess 50. The inside face 51 on the boss 46 at the upper forward end of space 49 of holder 40 prevents the end cap spindle from being batted forward and out of the holder as the cap end is lifted off of saddle 76, over shoulder 80 and on along with movement of the holder that is picked up the end cap. The space 49 permits the lower end cap to be lifted up in passing up and over shoulder 80 as an end cap is picked up from channel 70 by a holder 40. As the holder 40 proceeds along with the movement of carrier chain 32, the curved plate 72 comes into play to urge the end cap into the recess 50 of the end cap holder 40 so it finally assumes a position as shown in dotted lines on FIG. 6.

Now as the end cap holder on each carrier 30 is propelled along the curved plate 72, one on each side of the roll path 26, holds the end cap in the holder under the holder reaches the point where a roll, with its open core ends at the opposite sides of the roll path 26, being propelled by the blades 20 of paddle 18 aligns with the approaching two end cap holders. Then the end cap holders move along the inclined or sloped course portions 36 on the opposite sides of roll path 26. This forces the end caps inwardly toward the center line of the roll path 26 and thereby presses the end caps into the opposite open ends of the roll core. Thus, the end caps become firmly frictionally held in the roll core ends and as the roll moves on along the roll path 26 the holders 40, that have now served their purpose, move on around the trailing end of the carriers 30, freeing the roll with its now firmly engaged end caps in the core to move on out of the apparatus.

To supply the end cap feeder channels 70 with stacks of appropriate sized end caps with the spindles of the end caps extending through the longitudinal slot 74 of each feeder channel, there are provided at each side of the apparatus as shown in FIG. 1, rotary drum feeders 86. Each feeder is appropriately mounted to be associated with one of the feeder channels 70 to dispense end caps into the upper end of the feeder channel 70 with the end cap spindles extending through slot 74 of the channel.

The drum feeder has an annular outer wall 88 and a cylindrical wall 90 providing a compartment into which a quantity of end caps may be placed by introducing them through the opening in the annular outer wall 88. Preferrably, wall 90 is transparent, as by being clear plastic, for ease of viewing the end caps supply. Opposite wall 88 a ring 92 is secured by connecting bolts 93. The circumference of ring 92 has secured thereto an outwardly facing V-belt 94. This drum may conveniently be supported by a pair of idler pulleys 96 and driven by a third supporting pulley 98 which frictionally engages with the outwardly facing V-belt 94. The drive pulley 98 is suitably mounted on a shaft extending through backboard 100 which board also supports idler pulleys 96. The backboard completes the drum compartment for the end caps. This shaft carrying pulley 98 in turn is driven by a belt or chain 102 which is driven off of shaft 104 through a universal joint 106, this shaft 104 being driven by the gear motor 52 as shown in FIG. 17.

Figure 3:
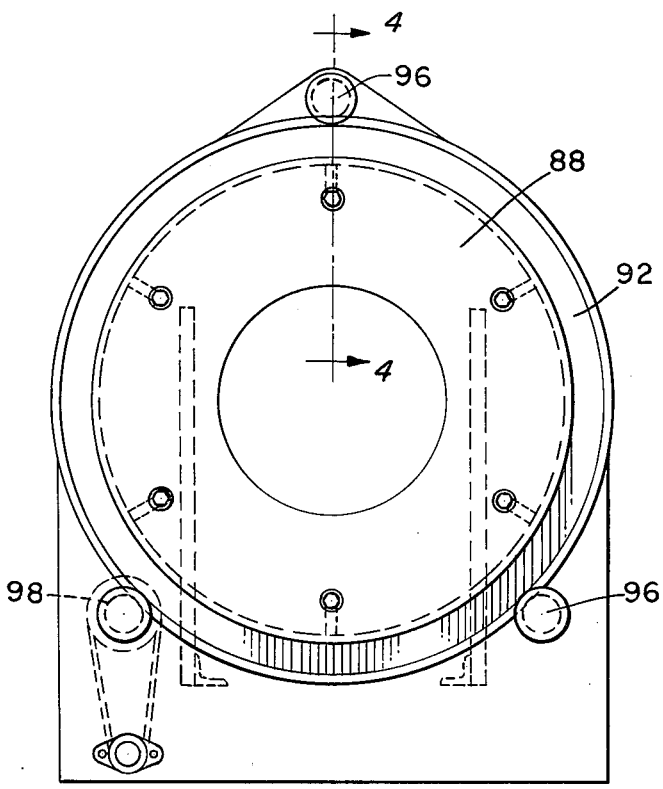
FIG. 3 is a view taken on line 3—3 of FIG. 1.
Figure 4:
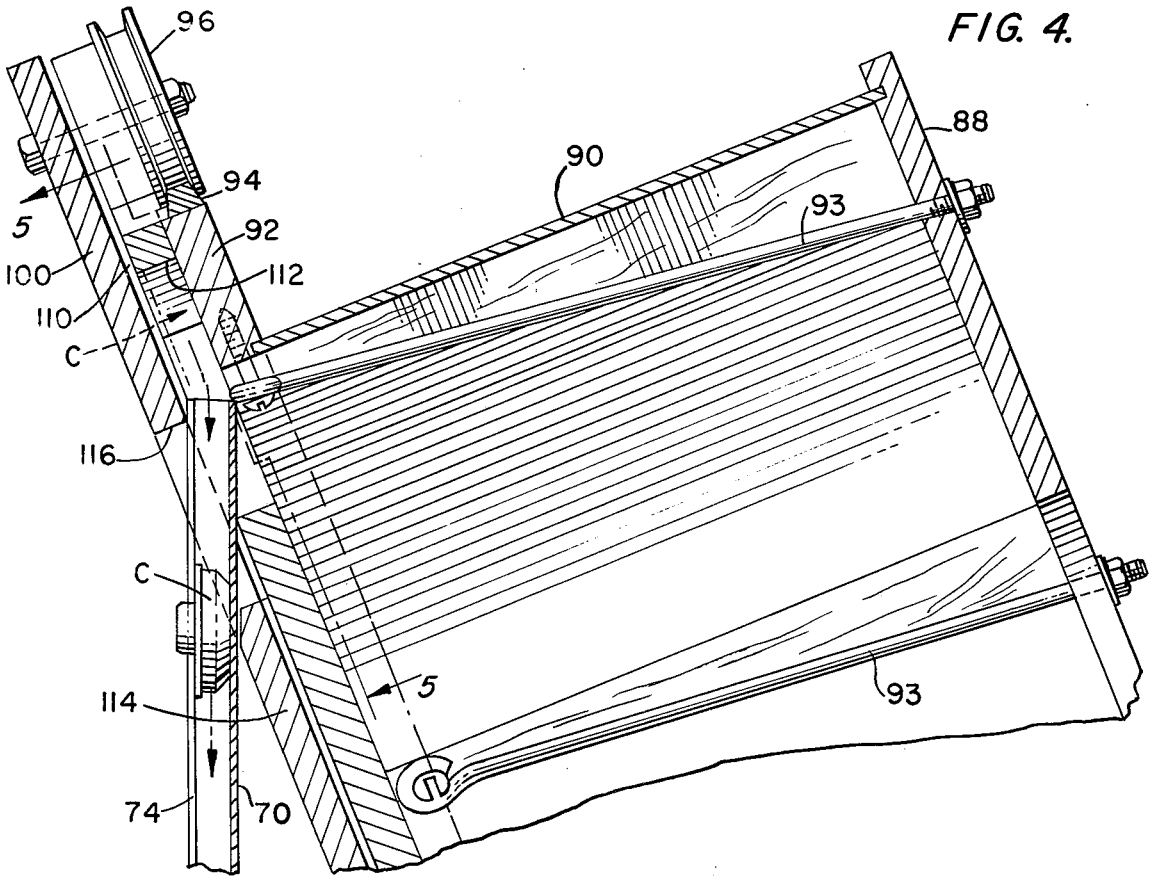
FIG. 4 is a sectional view taken on line 4—4 of FIG. 3.
Figure 5:
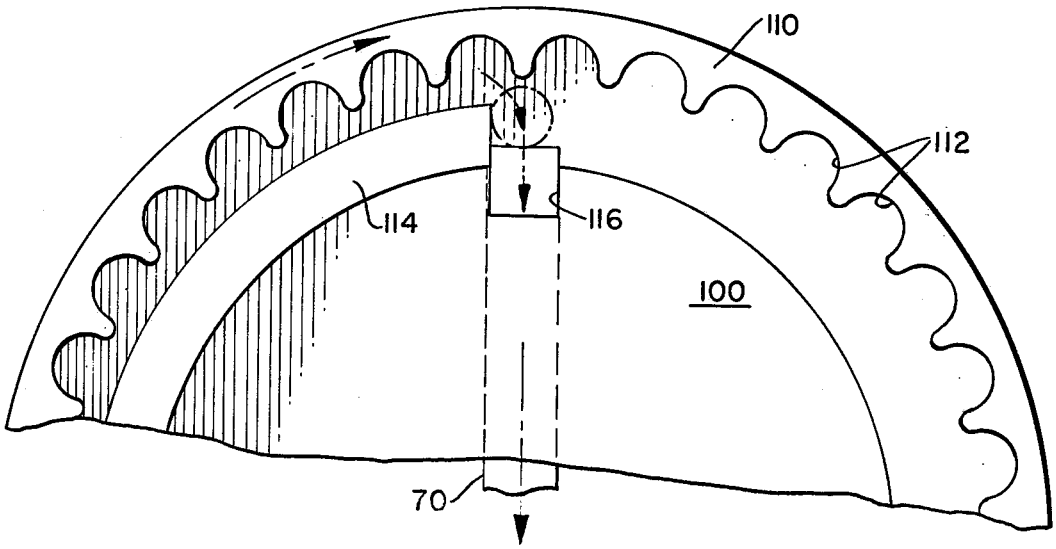
FIG. 5 is a view taken on line 5—5 of FIG. 4.

By the rotation of the rotary drum feeder and by the inclination of the axis of rotation, the end caps placed within the drum compartment are tumbled down toward the backboard 100 in drum feeder 86. The function of each drum feeder 86 is to pick up end caps in succession from the quantity of caps in the drum compartment, feed them up to the upper end of one of the feeder channels 70 and drop them in to form a stack of end caps within the feeder channel 70. The construction of the rotary drum feeder, as will be described hereinafter, is such that caps raised by the action of drum rotation will only enter the feeder channel 70 if they are oriented in a proper direction so that the spindle of the end cap can enter the slot 74 in the feeder channel 70. Since the operation of the two rotary feeder drums is basically similar, the details hereinafter will be given with respect to the rotary drum feeder 86 as shown in FIGS. 3, 4 and 5.

Ring 92 has affixed to it, on the side thereof facing the backboard 100, an annular member 110. This member has a series of circumferentially spaced pockets 112 formed to face radially inwardly of the member 110. Member 110 faces and moves relative to the stationary backboard 100 with member 110 rotating with the ring 92 and remaining portions of the rotating drum compartment. Semicircular segment 114 is secured to the backboard 100 in the position as shown in FIG. 5. Its position provides a space between the bottom of each pocket 112 and the radially outer surface of the segment 114 to accommodate the diameter of one end cap. End caps in position are shown in FIG. 5 in dotted lines. The space between rotating ring 92 and backboard 100 is designed to accommodate the axial length of one end cap (see end cap C shown in phantom in FIG. 4).

The backboard 100 has a dropout opening 116. The upper end of a feeder channel 70 extends into this opening for the upper open end of the channel to have dropped thereinto end caps that are brought up to the top of the opening and are properly oriented so that the spindles of the end cap can enter the top of the channel and move down in to the channel to form the stack of end caps that are retained for pickup by the end cap holders 40 on a carrier 30 mounted at the bottom of the feeder channel 70 as has previously been described.

With the rotation of the drum and its inclined position the end caps tend to move down within the drum compartment toward the annular member 110 and enter one or another of the pockets 112 around the inner periphery of member 110 to be moved in the pockets up to the top of the rotating drum. The semicircular segment 114 extends on backboard 100 for a sufficient arc that when the member 110 with end caps in its spaced pockets 112 nears the horizontal level where the end caps would proceed to fall out of the pockets 112 if segment 114 were not present, the semicircular segment acts to keep them in the pockets 112 as they move upwardly in the direction shown by the arrow on FIG. 5. When rotation of member 110 carries the pockets beyond the end of semicircular segment 114 the end caps now become free to fall out of the successive pockets 112 and either enter the feeder channel 70, if they are properly oriented, or, if not properly oriented, then fall back into the drum to be picked up by subsequent pockets 112 moving upwardly with the drum rotation.

As viewed in FIG. 4, the space between rotating ring 92 and the surface of backboard 100 is such that the axial length of an end cap C can be accommodated. The space between the outer most point of each pocket 112 and the outer radial surface of semicircular segment 114 is such that the diameter of an end cap is accommodated. The end caps are thus captured both diametrically and axially as they move toward the dropout opening 116 in the backboard 100. In FIG. 4 a properly oriented end cap C is shown falling down within feeder channel 70 to add to the stack of caps. It is oriented with the spindle passing through the slot 74 in the feeder channel 70. In the pocket 112, shown in section in FIG. 4, another properly oriented end cap C is shown in phantom lines. This end cap has its spindle facing toward the backboard 100 and is in a position to fall and properly also enter the top of feeder channel 70. However, in the rotation of the drum the end caps may enter the pockets 112 randomly with some having their spindles facing toward the backboard 100 and other having their spindles facing away from the backboard 100. For those end caps having the spindles facing away from the backboard 100 when they reach the top of their travel above the drop-out opening 116 in the backboard 100 they cannot enter the feeder channel 70 since an end cap spindle facing away from the backboard will not be able to fall down within the channel and the larger diameter portion of the end cap will be over the slot 74 in the feeder channel and thus it prevents that particular improperly oriented end cap from falling into the channel 70. In this situation the rotation of member 110 carrying its pockets 112 beyond the end of semicircular segment 114 will move the improperly oriented end cap past the upper end of the feeder channel 70 and permit the improperly oriented end cap to drop back into the quantity of end caps at the base of the rotating drum to be picked up again by the pockets in rotating member 110.

As previously mentioned, generally two different end caps are known and extensively used. The two types of caps are shown in FIGS. 13 through 16. One cap has a large spindle and the other cap has a small spindle. In practice the projecting spindle in the left end of the roll core is of greater diameter than the spindle on the right end of the roll core. This practice is followed to assure that the rolls are loaded properly into the dispenser to enable sheet material removal from the roll in proper functioning of the dispensing equipment. Thus, in utilizing the rotary drum feeders 86 it is important that the feeder be constructed so that if by chance wrong size spindles are loaded into or fall into the drum compartment, these wrong spindles will not be permitted to get into the feeding channel 70 and into the roll core.

Where the feeding channel slot 74 is made to accommodate only the small spindle end cap, it is impossible for the large spindle end cap to get into the end of the roll requiring the small spindle since the large spindle on an end cap would not be able to enter the longitudinal slot 74 of a feeder channel 70 to be used for the small spindle end cap. To provide means to prevent the small spindle from getting into the end cap supply having large spindle end cap inserting capability, a special drop out device for the drum handling the end caps with large spindles will be provided to ensure that a quantity or single end cap with a small spindle will be dropped out of the drum feeder without entering the feeder channel 70 associated with the drum feeder.

Although the present invention has been illustrated and described in terms of a preferred embodiment, numerous modifications may be made without departing from the true spirit and scope of the invention. The scope of the invention is therefore to be limited only by the appended claims.

We claim:

1. The method of inserting end caps into the ends of the cores of wound rolls such as toilet tissue, toweling and the like comprising the steps of:

driving a roll at a predetermined speed along a path with the roll core ends exposed at the sides of said path, moving an end cap holder at said predetermined speed along each side of said path in a course having a portion thereof that approaches the center line of said path, said end cap holder having means for encompassingly engaging a first axially extending section of said end cap, feeding an end cap to each of the holders, and encompassingly engaging said first axially extending end cap sections by the holders as the holders approach said portion of said course whereby the holders press a second axially extending section of the end caps into the core ends of the roll as the roll and holders travel in synchronism along said roll path.

2. The method as recited in claim 1 wherein a plurality of rolls are moved along said path at said predetermined speed in succession in parallel relation to each other, end cap holders are moved in spaced succession along each side of said path at said predetermined speed, the end cap holders at each side of said path following a course having a portion thereof that approaches the center line of said path, and end caps are fed to and the first axially extending sections thereof engaged by the holders as the holders approach said course portion.

3. The method as recited in claim 1 wherein each end cap holder at each side of said path moves in an endless course and the end caps are fed to and the first axially extending sections thereof engaged by the holders at points remote from the sides of said path where the end caps are pressed into the core ends.

4. The method as recited in claim 3 wherein each end cap holder at each side of said path moves in a generally oval course, and a supply stack of end caps are fed successively for the first axially extending sections thereof to be engaged by said holder as the holder moves along the segment of said generally oval course remote from the sides of said path.

5. The method as recited in claim 4 wherein end caps from a rotating feeder are oriented and introduced into said supply stack for proper engagement of said first axially extending end cap sections by the end cap holder for inserting into the roll core end.

6. Apparatus for inserting end caps into the ends of the cores of wound rolls such as toilet tissue, toweling and the like comprising:

means defining a roll path for transporting a roll to have end caps inserted into the core ends of the roll, roll driving means mounted along the path to transport said roll along said path at a predetermined speed with the roll core ends exposed at the sides of said path, an end cap holder at each of the sides of said path mounted on carrier means disposed at the opposite sides of said path, each said carrier means being supported to move in a course having a portion thereof approaching the center line of said roll path and being driven at said predetermined speed of said roll as transported by said roll driving means along a side of said roll path, each said end cap holder having means for encompassingly engaging a first axially extending section of said end caps, and means to supply end caps to each end cap holder for encompassing engagement of said first axially extending end cap section by said end cap holder and for insertion of a second axially extending section of said end caps into the roll core ends as said roll driving means and carrier means pass synchronously along said roll path.

7. Apparatus as recited in claim 6 wherein said roll driving means comprises a driven roll positioning paddle having radial blades thereon, said paddle being mounted to rotate on an axis below and perpendicular to the center line of said roll path for said blades to engage said roll and move it along said roll path in synchronism with movement of said end cap holders.

8. Apparatus as recited in claim 7 wherein a downwardly inclined roll feeding trough leads to said roll path to feed rolls to said roll positioning paddle.

9. Apparatus as recited in claim 8 wherein a roll retainer plate is mounted spaced above said trough and said paddle to retain rolls in position for end cap insertion.

10. Apparatus as recited in claim 7 wherein each carrier means at the opposite sides of said roll path moves in an endless course, a plurality of end cap holders are spacedly mounted along each carrier means, and feeder means supply the end caps to each carrier means remote from the side of said roll path.

11. Apparatus as recited in claim 6 wherein each carrier means at the opposite sides of said roll path moves in an endless course with a plurality of end cap holders spacedly mounted along each carrier means.

12. Apparatus as recited in claim 11 wherein the endless course is generally oval, and said means to supply end caps includes a supply stack feeder channel adjacent each carrier means endless course to deliver end caps to said end cap holders for engagement of said first axially extending end cap sections as the end cap holders pass said channel on the carrier means.

13. Apparatus as recited in claim 12 wherein each of said supply stack feeder channels has a rotating drum feeder associated therewith which holds a quanity of end caps and delivers end caps oriented to stack in said channels so that said first axially extending end cap sections will be engaged by said end cap holders.

14. Apparatus as recited in claim 12 wherein each feeder channel has a longitudinal slot therein for said first axially extending end cap sections comprising end cap spindles to project therethrough for each end cap to be removed from the channel by an end cap holder engaging the end cap spindle.

15. Apparatus as recited in claim 14 wherein each feeder channel has a saddle at the lower end of said longitudinal channel to support the spindle of the lowermost end cap in the channel, each channel has a lateral opening from its slot adjacent said saddle, and a shoulder is provided between said saddle and the outer end of said lateral opening to restrain movement of the lowermost end cap until the spindle thereof is engaged by an end cap holder.

16. Apparatus as recited in claim 15 wherein each end cap holder has an outwardly projecting boss with a laterally opening slot whereby the end cap spindle of said lowermost end cap passes through said slot and is contacted by said boss as said end cap holder passes said saddle to move said lowermost end cap spindle over said shoulder, and a recess extending into the holder from said boss and laterally opening slot by which said lowermost end cap spindle is encompassingly engaged.

17. Apparatus as recited in claim 16 wherein a curved guide extends along the course of said carrier means from said feeder channels to the sides of the roll path to hold the end caps on the end cap holders and seat each end cap spindle into said recess of the holder.

18. Apparatus as recited in claim 6 wherein each carrier means traverses an endless generally oval course, a plurality of end cap holders are spacedly mounted along said carrier means, a supply stack feeder channel is mounted adjacent each carrier means to deliver end caps to said end cap holders as they pass said channel, a rotating drum feeder is associated with each feeder channel, and said roll driving means and said carrier means have a common drive connection for their synchronous operation at said predetermined speed.

19. Apparatus as recited in claim 16 wherein the dimensions of said slot opening and the distance between the upper and lower inside surfaces of said boss are larger than the transverse cross-sectional dimension of said end cap spindles so that said lowermost end cap spindle will be received through said slot and said boss will contact said lowermost end cap spindle with the spindle being accepted into and accommodated by said boss while the spindle is raised over said shoulder.

* * * * *